US007667380B2

(12) United States Patent
Hwang

(10) Patent No.: US 7,667,380 B2
(45) Date of Patent: Feb. 23, 2010

(54) ELECTRON EMISSION DEVICE USING THICK-FILM INSULATING STRUCTURE

(75) Inventor: Seong-Yeon Hwang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 316 days.

(21) Appl. No.: 11/211,329

(22) Filed: Aug. 24, 2005

(65) Prior Publication Data

US 2006/0043874 A1 Mar. 2, 2006

(30) Foreign Application Priority Data

Aug. 30, 2004 (KR) ..... 10-2004-0068521
Aug. 30, 2004 (KR) ..... 10-2004-0068745

(51) Int. Cl.

| | |
|---|---|
| ***H01J 1/62*** | (2006.01) |
| ***H01J 63/04*** | (2006.01) |
| *H01J 9/02* | (2006.01) |
| *H01J 1/304* | (2006.01) |

(52) U.S. Cl. ..... 313/495; 313/310; 313/496; 445/24

(58) Field of Classification Search ..... 313/495–498
See application file for complete search history.

(56) References Cited

U.S. PATENT DOCUMENTS

| | | | | |
|---|---|---|---|---|
| 5,228,878 | A * | 7/1993 | Komatsu | 445/24 |
| 5,719,477 | A * | 2/1998 | Tomihari | 315/381 |
| 5,786,656 | A * | 7/1998 | Hasegawa et al. | 313/308 |
| 5,831,387 | A | 11/1998 | Kaneko et al. | |
| 5,965,977 | A * | 10/1999 | Makishima | 313/495 |
| 6,333,598 | B1 | 12/2001 | Hsu et al. | |
| 6,384,520 | B1 * | 5/2002 | Russ | 313/311 |
| 6,437,503 | B1 * | 8/2002 | Konuma | 313/495 |
| 2002/0030436 | A1 * | 3/2002 | Ichikawa | 313/495 |
| 2002/0050776 | A1 * | 5/2002 | Kubota et al. | 313/309 |
| 2003/0001490 | A1 * | 1/2003 | Yamamoto et al. | 313/495 |
| 2003/0015958 | A1 * | 1/2003 | Saito et al. | 313/495 |

(Continued)

FOREIGN PATENT DOCUMENTS

CN 1462464 A 12/2003

(Continued)

OTHER PUBLICATIONS

European Office action dated Oct. 4, 2007, for EP 05 107 880.6, in the name of Samsung SDI Co., Ltd.

(Continued)

*Primary Examiner*—Sikha Roy
*Assistant Examiner*—Tracie Green
(74) *Attorney, Agent, or Firm*—Christie, Parker & Hale, LLP

(57) ABSTRACT

An electron emission device includes first and second substrates facing each other, cathode electrodes formed on the first substrate, and electron emission regions formed on the cathode electrodes. An insulating layer is formed on the cathode electrodes with opening portions exposing the electron emission regions. Gate electrodes are formed on the insulating layer with opening portions corresponding to the opening portions of the insulating layer. Phosphor layers are formed on the second substrate. At least one anode electrode is formed on a surface of the phosphor layers. The cathode and the gate electrodes are formed by thin filming, and the insulating layer is formed by thick filming.

6 Claims, 12 Drawing Sheets

U.S. PATENT DOCUMENTS

| | | | | |
|---|---|---|---|---|
| 2003/0102797 | A1* | 6/2003 | Kajiwara | 313/486 |
| 2003/0214218 | A1* | 11/2003 | Itoh et al. | 313/446 |
| 2004/0027051 | A1* | 2/2004 | Moradi et al. | 313/495 |
| 2004/0080260 | A1* | 4/2004 | Park et al. | 313/495 |
| 2004/0130510 | A1 | 7/2004 | Konishi et al. | |
| 2005/0035701 | A1* | 2/2005 | Choi et al. | 313/309 |

FOREIGN PATENT DOCUMENTS

| | | | |
|---|---|---|---|
| EP | 1 130 617 | A1 | 9/2001 |
| EP | 1 429 363 | A2 | 6/2004 |
| WO | WO 2005/029528 | A1 | 3/2005 |

OTHER PUBLICATIONS

European Search Report dated Apr. 4, 2007, for EP 05107880.6, in the name of Samsung SDI Co., Ltd.

* cited by examiner

ELECTRON EMISSION DEVICE USING THICK-FILM INSULATING STRUCTURE

CROSS REFERENCES TO RELATED APPLICATIONS

The application claims priority to and the benefit of Korean Patent Application Nos. 10-2004-0068521 and 10-2004-0068745 filed in the Korean Intellectual Property Office on the same day of Aug. 30, 2004, the entire contents of which are incorporated herein by reference.

BACKGROUND OF THE INVENTION

1. Field of the Invention

The present invention relates to an electron emission device and a method of manufacturing the same, and in particular, to an electron emission device having electron emission regions for emitting electrons and driving electrodes for controlling the electron emission.

2. Description of Related Art

Generally, electron emission devices are classified into a first type where a hot cathode is used as an electron emission source, and a second type where a cold cathode is used as the electron emission source.

Among the second type electron emission devices there are known the field emitter array (FEA) type, the surface conduction emission (SCE) type, the metal-insulator-metal (MIM) type, and the metal-insulator-semiconductor (MIS) type.

The electron emission devices are differentiated in their specific structure depending upon the type thereof, but basically have first and second substrates forming a vacuum vessel. Electron emission regions and driving electrodes are formed on the first substrate, and phosphor layers and an anode electrode are formed on the second substrate. With this structure, electrons are emitted from the electron emission regions toward the second substrate and excite the phosphor layers for making light emission or displaying desired images.

With the common FEA type electron emission device, cathode and gate electrodes are provided as the driving electrodes, and a focusing electrode is formed on the gate electrodes to focus the electron beams. In order to prevent the electrodes from being short circuited, first and second insulating layers are formed between the cathode and the gate electrodes and between the gate and the focusing electrodes, respectively.

In the conventional manufacturing of the above-structured FEA type electron emission device, the electrodes and the insulating layers are formed through only one process, taking into consideration simplified processing facilities and easy processing methodology. That is, the electrodes and the insulating layers are formed either through sputtering or vacuum deposition, or through screen-printing or laminating. For convenience, the former technique is called "thin filming," and the latter technique is called "thick filming."

When the electron emission device is completed utilizing only thin filming, the height difference between the electron emission regions and the focusing electrode is not so large as to heighten the electron beam focusing efficiency. Furthermore, when the electron emission regions are formed with thick filming, such as the screen-printing, the gate electrodes are placed at the plane lower than the electron emission regions so that it becomes difficult to control the electron emission, and the electron beams can be seriously diffused.

Accordingly, with the FEA type electron emission device, it has been preferable to form the insulating layer with a thickness of 1 μm or more. However, when the insulating layers with such a thickness are formed by thin filming, the stability and processing efficiency of the insulating layers deteriorates, making it difficult for mass production.

Furthermore, with the electron emission device completed through only thick filming, it is difficult to provide precise patterning, limiting the ability to make high resolution and high image quality devices.

Further, after the insulating layer is formed by thick filming, it is etched using wet etching to form opening portions. In this case, the electrodes formed on the insulating layer are used as an etching mask. That is, after the opening portions are formed at the focusing electrode, the second insulating layer is etched using the focusing electrode as an etching mask. After the opening portions are formed at the gate electrodes, the first insulating layer is etched using the gate electrodes as an etching mask.

However, since wet etching is made in an isotropic manner, the so-called undercut phenomenon, where the opening portions of the insulating layer are formed to be larger than those of the mask layer, is generated. Accordingly, the gate electrodes are partially suspended over the opening portions of the first insulating layer, and the focusing electrode is partially suspended over the opening portions of the second insulating layer, thereby deteriorating the shape stability of the electrodes.

Furthermore, when the insulating layer is formed by thick filming, it has a rough etching surface being the wall surface of the opening portions thereof so that the opening portions thereof have a rough plane shape. As a result, the opening portions of the gate electrodes and the focusing electrode formed on the insulating layer also have a rough plane shape proceeding along the shape of the opening portions of the insulating layer.

With the above-structured electron emission device, the electron emission characteristics become non-uniform due to the lower degree of shape precision of the electrodes and the insulating layers, and unintended discharge phenomenon and generation of leakage of current, make it difficult to form the device in a stable manner.

SUMMARY OF THE INVENTION

In accordance with the present invention, an electron emission device and a method of manufacturing the electron emission device is provided which heightens the shape stability and patterning precision of the insulating layers and the electrodes, and enhances the processing efficiency, thereby making it possible to fabricate a high resolution and high image quality device.

In an exemplary embodiment of the present invention, there is provided an electron emission device and a method of manufacturing the electron emission device which when the insulating layer is formed by thick filming and wet-etched to form opening portions, the gate and the focusing electrodes have opening portions with an even plane shape, thereby stabilizing electron emission characteristics.

In an exemplary embodiment of the present invention, the electron emission device includes first and second substrates facing each other, cathode electrodes formed on the first substrate, and electron emission regions formed on the cathode electrodes. An insulating layer is formed on the cathode electrodes with opening portions exposing the electron emission regions. Gate electrodes are formed on the insulating layer with opening portions corresponding to the opening portions of the insulating layer. The cathode and the gate electrodes are formed by thin filming, and the insulating layer is formed by thick filming. The cathode and the gate electrodes may be formed with a thickness of 2,000-3,000 Å, respectively. The insulating layer may have a thickness of 3 μm or more. The opening portion of the gate electrode may have a width larger than the opening portion of the insulating layer.

In another exemplary embodiment of the present invention, the electron emission device includes first and second substrates facing each other, cathode electrodes formed on the first substrate, electron emission regions formed on the cathode electrodes, and gate electrodes formed over the cathode electrodes with a first insulating layer interposed between the gate electrodes and the cathode electrodes. At least one focusing electrode is formed over the gate electrodes while a second insulating layer is interposed between the at least one focusing electrode and the gate electrodes. The first insulating layer, the gate electrodes, the second insulating layer and the focusing electrode have opening portions exposing the electron emission regions, respectively. The cathode electrodes, the gate electrodes and the focusing electrode are formed by thin filming, and the first and the second insulating layers are formed by thick filming. The cathode electrodes, the gate electrodes and the focusing electrode may have a thickness of 2,000-3,000 Å, respectively. The first and the second insulating layers may have a thickness of 3 μm or more, respectively. The opening portions of the gate electrodes may have a width larger than the opening portions of the first insulating layer. The opening portions of the focusing electrode may have a width larger than the opening portions of the second insulating layer.

In a method of manufacturing the electron emission device, cathode electrodes are first formed on a substrate by thin filming. An insulating layer is formed on the entire surface of the substrate by thick filming such that the insulating layer covers the cathode electrodes. A gate electrode layer is formed on the insulating layer by thin filming, and opening portions are formed at the gate electrode layer. The insulating layer is wet-etched using the gate electrode layer as an etching mask to form opening portions at the insulating layer. The gate electrode layer is stripe-patterned to form gate electrodes. Electron emission regions are formed on the cathode electrodes within the opening portions of the insulating layer. The thin filming may be by vacuum deposition or sputtering, and the cathode and the gate electrodes are formed with a thickness of 2,000-3,000 Å, respectively. The thick filming may be by any one of screen-printing, laminating or doctor blade, and the insulating layer is formed with a thickness of 3 μm or more. When the gate electrodes are stripe-patterned, they may be further etched to extend the opening portions thereof.

In another method of manufacturing the electron emission device, cathode electrodes are formed on a substrate by thin filming. A first insulating layer is formed on the entire surface of the substrate by thick filming such that the first insulating layer covers the cathode electrodes. Gate electrodes with opening portions are formed on the first insulating layer by thin filming. A second insulating layer is formed on the entire surface of the substrate by thick filming such that the second insulating layer covers the gate electrodes. A focusing electrode is formed on the second insulating layer by thin filming, and opening portions are formed at the focusing electrode. The second insulating layer is wet-etched using the focusing electrode as an etching mask to form opening portions at the second insulating layer, and the first insulating layer is wet-etched using the gate electrodes as an etching mask to form opening portions at the first insulating layer. Electron emission regions are formed on the cathode electrodes within the opening portions of the first insulating layer. After the formation of the opening portions at the second insulating layer, the focusing electrode may be further etched to extend the opening portions thereof. Furthermore, after the formation of the opening portions at the first insulating layer, the gate electrodes may be further etched to extend the opening portions thereof.

DETAILED DESCRIPTION

Figure 1:
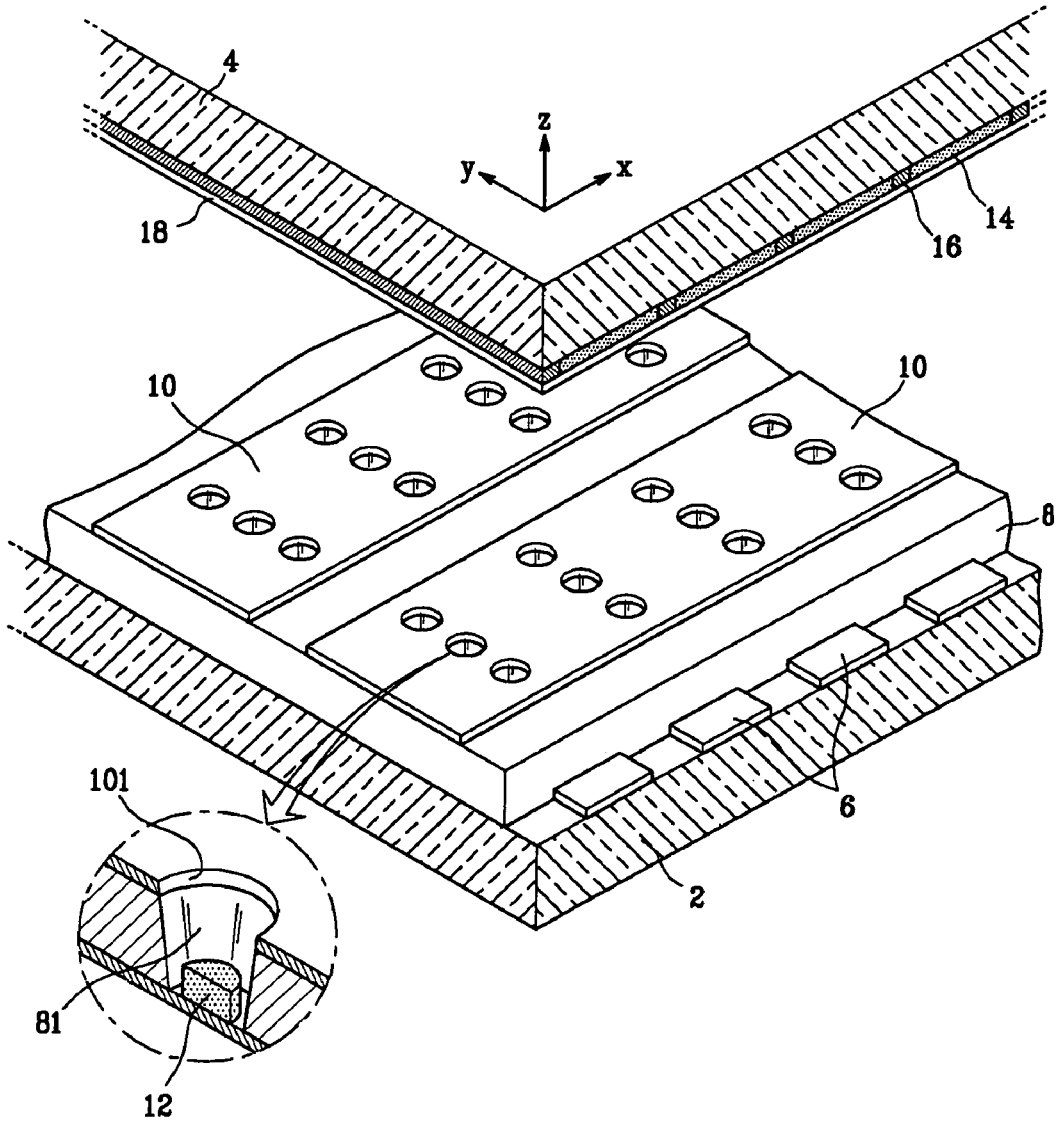
FIG. 1 is a partial exploded perspective view of an electron emission device according to a first embodiment of the present invention.
Figure 2:
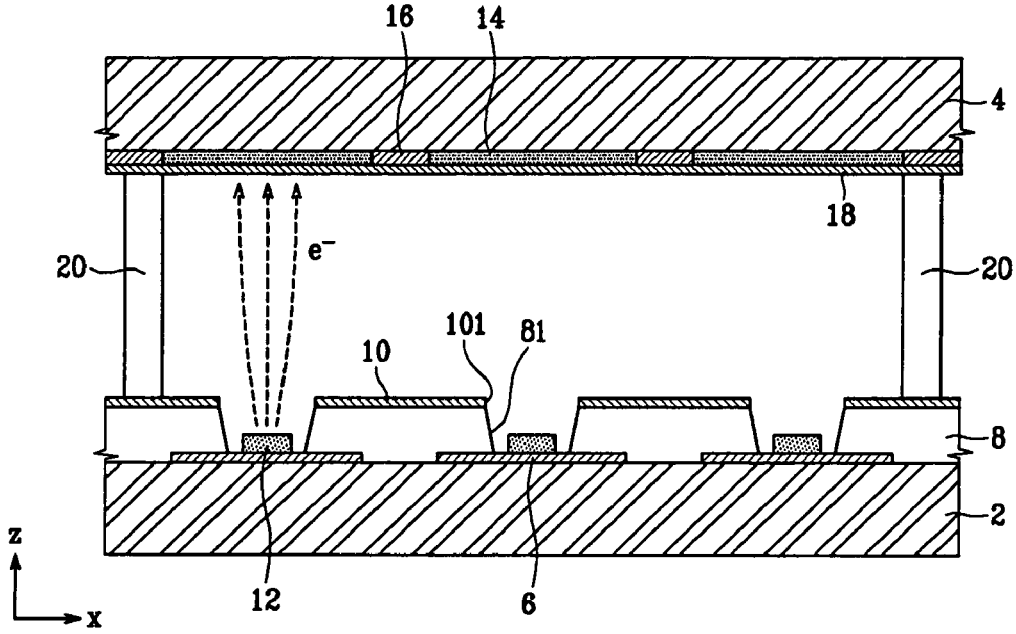
FIG. 2 is a partial sectional view of the electron emission device according to the first embodiment of the present invention.

As shown in FIGS. 1 and 2, an electron emission device according to a first embodiment of the present invention includes first and second substrates 2 and 4 facing each other at a predetermined distance. An electron emission structure is provided at the first substrate 2 to emit electrons, and a light emission or display structure at the second substrate 4 to emit visible rays and display the desired images.

Specifically, cathode electrodes 6 are stripe-patterned on the first substrate 2 in a direction of the first substrate 2 (in the y axis direction of the drawing). An insulating layer 8 is formed on the entire surface of the first substrate 2 while covering the cathode electrodes 6. Gate electrodes 10 are stripe-patterned on the insulating layer 8 while proceeding substantially perpendicular to the cathode electrodes 6.

The crossed regions of the cathode and the gate electrodes 6 and 10 form sub-pixel regions, and one or more electron emission regions 12 are formed on the cathode electrodes 6 at the respective sub-pixel regions. Opening portions 101 and 81 are formed at the gate electrodes 10 and the insulating layer 8 corresponding to the respective electron emission regions 12 while exposing the electron emission regions 12 on the first substrate 2.

The electron emission regions 12 are formed with a material emitting electrons under the application of an electric field, such as a carbonaceous material or a nanometer-sized material. In exemplary embodiments the electron emission regions 12 are formed with carbon nanotube, graphite, graphite nanofiber, diamond, diamond-like carbon, $C_{60}$, silicon nanowire, or a combination thereof. The formation of the electron emission regions may be made using the technique of screen-printing, direct growth, chemical vapor deposition, or sputtering.

It is illustrated in the drawings that the electron emission regions 12 are formed with a circular shape, and linearly arranged along the length of the cathode electrodes 6. However, the plane shape, number per sub-pixel and arrangement of the electron emission regions 12 are not limited thereto, but may be altered in various manners.

A film having a thickness of 1 μm or more and formed through thick filming, such as screen-printing, laminating or doctor blade, is defined as "thick film," and the insulating layer 8 according to the present embodiment is formed as a thick film. The insulating layer 8 has a thickness of 3 μm or more, particularly of 3-30 μm, and is formed by thick filming.

On the other hand, a film having a thickness of less than 1 μm, particularly of several thousands angstroms, and formed through thin filming, such as sputtering or vacuum deposition, is defined as "thin film," and the cathode and the gate electrodes 6 and 10 are formed as a thin film. The cathode and the gate electrodes 6 and 10 are formed with a thickness of 2,000-3,000 Å, respectively.

The thick-filmed insulating layer 8 has the role of heightening the uniformity in electron emission by making the gate electrodes 10 bear a sufficient height with respect to the electron emission regions 12. The advantage becomes further enhanced when the electron emission regions 12 are formed by thick filming, such as screen-printing. The thin-filmed cathode and gate electrodes 6 and 10 can be precisely patterned, thereby achieving excellent shape precision.

Thereafter, red, green and blue phosphor layers 14 are formed on a surface of the second substrate 4 facing the first substrate 2 while being spaced apart from each other by a distance. Black layers 16 are formed between the neighboring phosphor layers 14 to enhance the screen contrast. An anode electrode 18 is formed on the phosphor layers 14 and the black layers 16 with a metallic film based on aluminum (Al).

The anode electrode 18 receives the high voltage required for accelerating the electron beams from the outside, and reflects the visible rays radiated from the phosphor layers 14 to the first substrate 2 toward the second substrate 4, thereby enhancing the screen luminance.

Alternatively, the anode electrode may be formed with a transparent conductive film based on indium tin oxide (ITO), instead of the metallic film. In this case, the anode electrode is formed on a surface of the phosphor layers and the black layers facing the second substrate. The anode electrode may be patterned with a plurality of separate portions.

Spacers 20 are arranged between the first and the second substrates 2 and 4 sealed to each other at their peripheries. The inner space between the first and the second substrates 2 and 4 is exhausted to be in a vacuum state, thereby constructing an electron emission device. The spacers 20 are placed at the non-light emission area where the black layers 16 are located.

The above-structured electron emission device is driven by applying predetermined voltages to the cathode electrodes 6, the gate electrodes 10 and the anode electrode 18. For instance, driving voltages with a voltage difference of several to several tens volts (scanning voltages and data voltages) are applied to the cathode and the gate electrodes 6 and 10. A plus (+) voltage of several hundred to several thousand volts is applied to the anode electrode 18.

Accordingly, electric fields are formed around the electron emission regions 12 at the sub-pixels where the voltage difference between the cathode and the gate electrodes 6 and 10 exceeds the threshold value, and electrons are emitted from those electron emission regions 12. The emitted electrons are attracted by the high voltage applied to the anode electrode 18, thereby colliding against the corresponding phosphor layers 14 and light-emitting them.

A method of manufacturing the electron emission device according to the first embodiment of the present invention will be now explained with reference to FIGS. 3A to 3C.

Figure 3A:
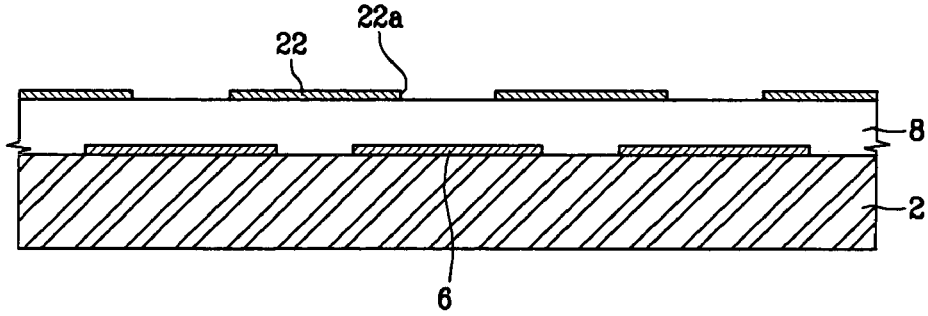
FIGS. 3A, 3B and 3C sequentially illustrate the steps of manufacturing the electron emission device according to the first embodiment of the present invention.

First, as shown in FIG. 3A, a conductive layer is formed on the first substrate 2, and stripe-patterned to thereby form cathode electrodes 6. An insulating layer 8 is formed on the entire surface of the first substrate 2 such that it covers the cathode electrodes 6.

The insulating layer 8 is formed by thick filming, such as screen-printing, laminating or doctor blade, such that it has a thickness of 1 μm or more, and in an exemplary embodiment of 3-30 μm. For instance, a glass frit is repeatedly screen-printed, dried and fired two or more times to thereby form the insulating layer 8 with such a thickness.

A gate electrode layer 22 is formed through sputtering or vacuum-depositing a conductive material on the insulating layer 8. That is, the gate electrode layer 22 is formed by thin filming such that it has a thickness of 2,000-3,000 Å. The gate electrode layer 22 is formed with a metallic material, such as chromium (Cr), silver (Ag), aluminum (Al), and molybdenum (Mo). The gate electrode layer 22 is patterned through photolithography and etching to thereby form opening portions 221 at the crossed regions thereof with the cathode electrodes 6.

Figure 3B:
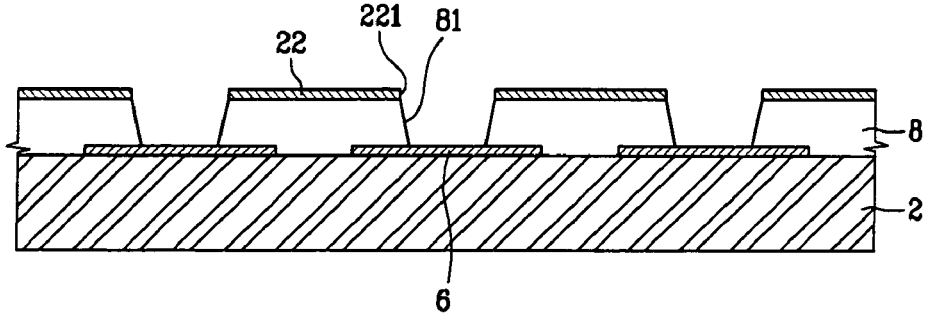

As shown in FIG. 3B, the insulating layer 8 is wet-etched using the gate electrode layer 22 as an etching mask. Opening portions 81 are formed at the insulating layer 8 while partially exposing the surface of the cathode electrodes 6. The gate electrode layer 22 is stripe-patterned through photolithography and etching substantially perpendicular to the cathode electrodes 6, thereby forming gate electrodes 10.

Figure 3C:
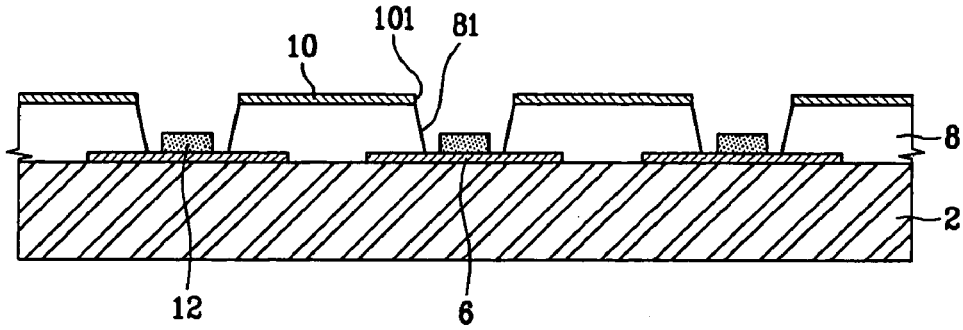

Thereafter, as shown in FIG. 3C, electron emission regions 12 are formed on the cathode electrodes 6 within the opening portions 81 of the insulating layer 8.

In order to form the electron emission regions 12, an organic material such as a vehicle and a binder, and a photosensitive material are mixed with a powdered electron emission material to prepare a paste-phased mixture with a viscosity suitable for the printing. The mixture is screen-printed onto the entire surface of the first substrate 2, and ultraviolet rays are illuminated to the locations thereof to be formed with electron emission regions 12 through the backside of the first substrate 2, thereby partially hardening the mixture. The non-hardened mixture is then removed. In this case, the first substrate 2 is formed with a transparent material, and the cathode electrodes 6 with a transparent conductive film based on ITO.

The electron emission regions 12 may be formed using the technique of direct growth, sputtering, or chemical vapor deposition.

Figure 4:
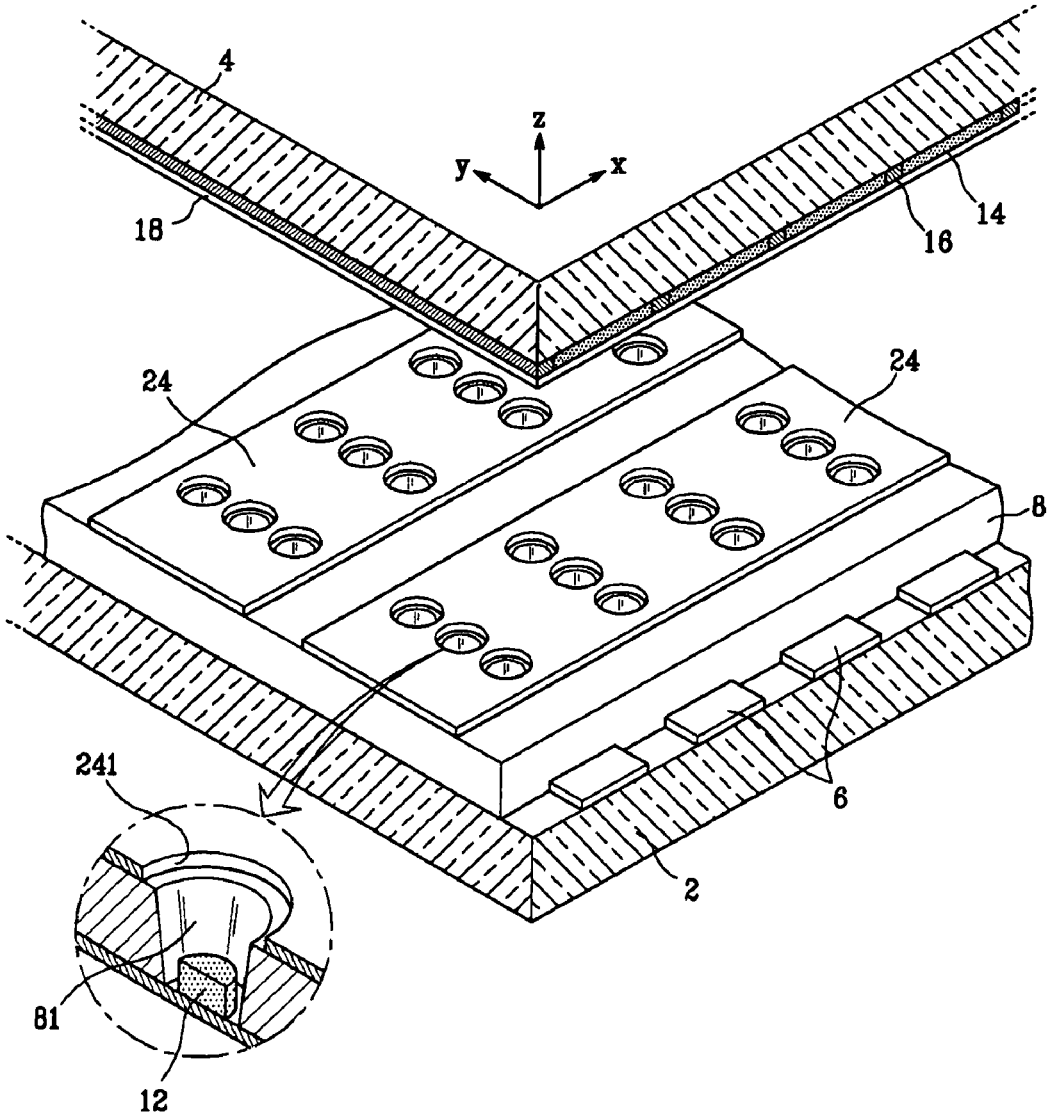
FIG. 4 is a partial exploded perspective view of an electron emission device according to a second embodiment of the present invention.
Figure 5:
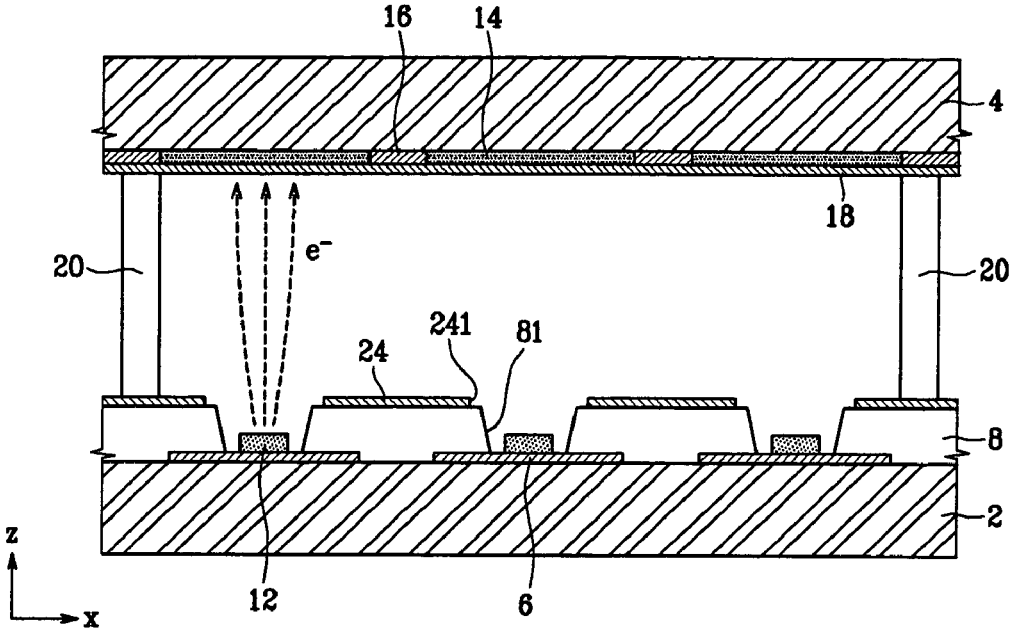
FIG. 5 is a partial sectional view of the electron emission device according to the second embodiment of the present invention.

As shown in FIGS. 4 and 5, an electron emission device according to a second embodiment of the present invention has the basic structural components of the electron emission device related to the first embodiment of the present invention as well as gate electrodes 24 with the shape to be explained below.

In this embodiment, the gate electrodes 24 have opening portions 241 with a width larger than the opening portions 81 of the insulating layer 8. The opening portions 241 of the gate electrodes 24 partially expose the surface of the insulating layer 8 around the opening portions 81 of the insulating layer 8. The opening portions 241 of the gate electrodes 24 provide excellent shape precision, and are spaced apart from the electron emission regions 12 uniformly at a predetermined distance.

A method of manufacturing the electron emission device according to the second embodiment of the present invention will be now explained with reference to FIGS. 6A to 6D.

Figure 6A:
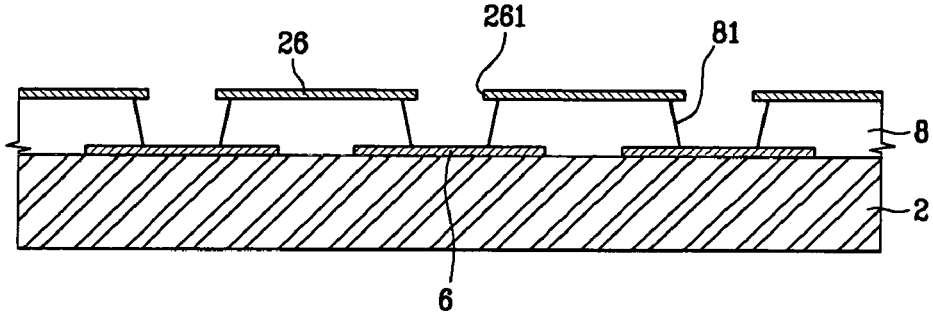
FIGS. 6A, 6B, 6C and 6D sequentially illustrate the steps of manufacturing the electron emission device according to the second embodiment of the present invention.

First, as shown in FIG. 6A, cathode electrodes 6, an insulating layer 8 and a gate electrode layer 26 with opening portions 261 are sequentially formed on the first substrate 2. The insulating layer 8 is wet-etched using the gate electrode layer 26 as an etching mask. Opening portions 81 are formed at the insulating layer 8 while partially exposing the surface of the cathode electrodes 6. The relevant processing steps conducted up to now are the same as those related to the first embodiment.

The insulating layer 8 formed by thick filming has a rough etching surface. That is, the opening portions 81 of the insulating layer 8 have a rough wall surface. Furthermore, the opening portions 81 of the insulating layer 8 are formed to be larger than the opening portions 261 of the gate electrode layer 26 due to the wet etching, and a part of the gate electrode layer 26 is suspended over the opening portions 81 of the insulating layer 8.

Figure 6B:
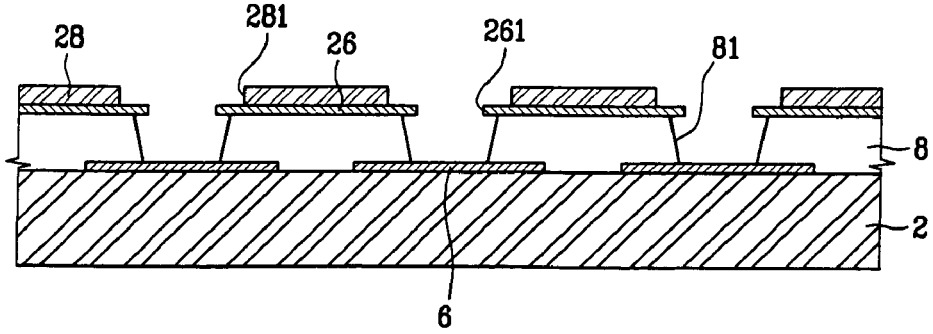
Figure 6C:
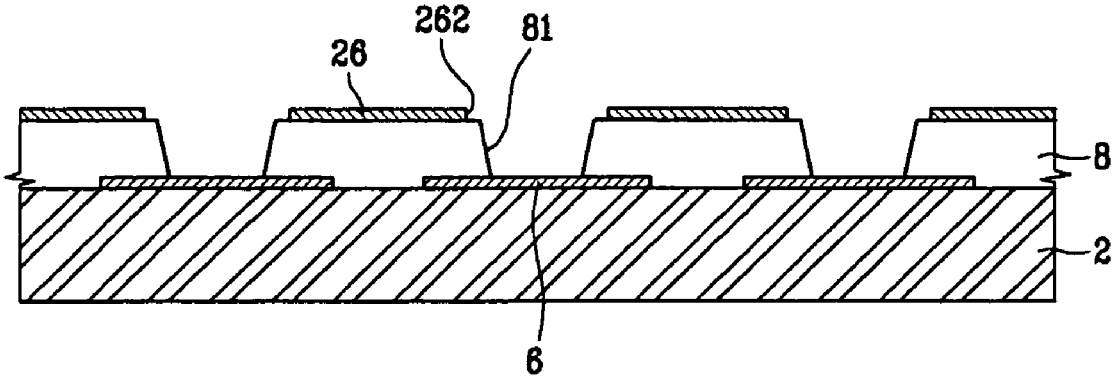

Accordingly, as shown in FIG. 6B, a mask layer 28 is formed on the gate electrode layer 26, and patterned to thereby form opening portions 281 over the opening portions 261 of the gate electrode layer 26 with a width larger than the opening portions 81 of the insulating layer 8. As shown in FIG. 6C, the portions of the gate electrode layer 26 exposed through the opening portions 281 of the mask layer 28 are etched to thereby form opening portions 262 at the gate electrode layer 26 with a width larger than the opening portions 81 of the insulating layer 8.

Stripe-patterned opening portions (not shown) are formed at the mask layer 28, and the gate electrode layer 26 is etched through the mask layer 28, thereby forming stripe-shaped gate electrodes 24. The mask layer 28 is then removed.

Figure 6D:
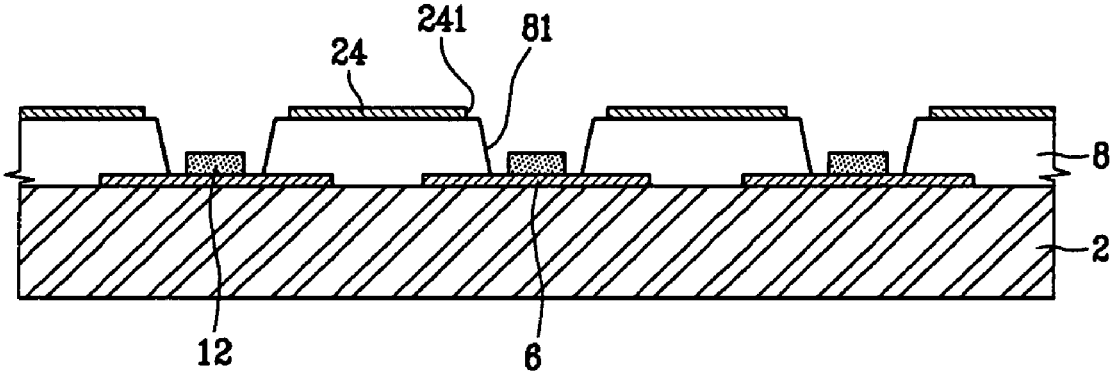

As shown in FIG. 6D, electron emission regions 12 are formed on the cathode electrodes 6 within the opening portions 81 of the insulating layer 8. The formation of the electron emission regions 12 is made in the same way as with that related to the first embodiment.

With the above-described method, after opening portions 81 are formed at the insulating layer 8, the gate electrode layer 26 may be etched once more using a separate mask layer 28 to thereby form opening portions 262 with excellent shape precision irrespective of the shape of the opening portions 81 of the insulating layer 8. The gate electrodes 24 may be spaced apart from the electron emission regions 12 uniformly at a predetermined distance. As a result, the uniformity in electron emission becomes enhanced.

Figure 7:
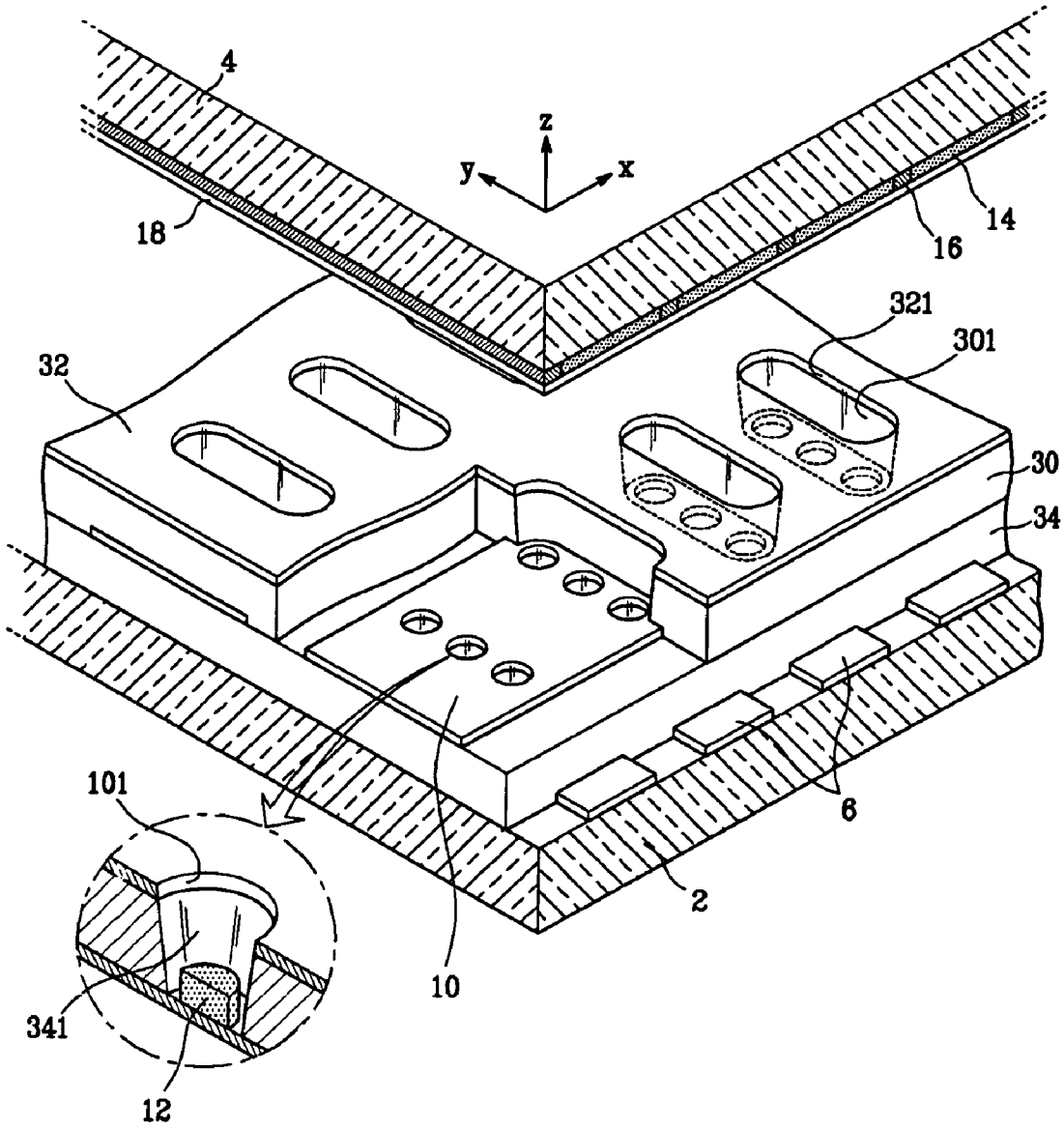
FIG. 7 is a partial exploded perspective view of an electron emission device according to a third embodiment of the present invention.
Figure 8:
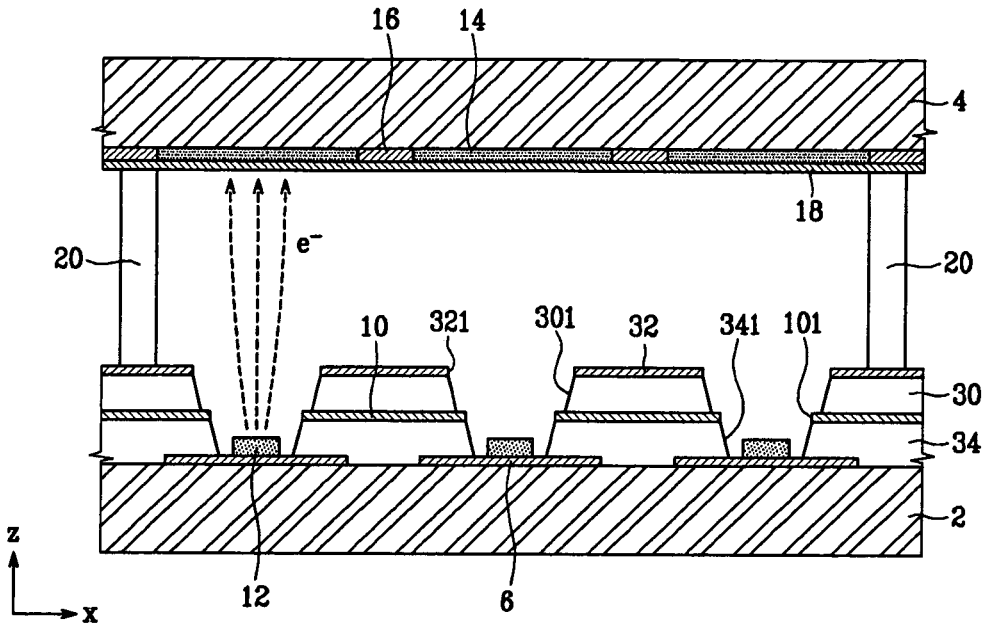
FIG. 8 is a partial sectional view of the electron emission device according to the third embodiment of the present invention.

As shown in FIGS. 7 and 8, an electron emission device according to a third embodiment of the present invention has the basic structural components of the electron emission device related to the first embodiment as well as a second insulating layer 30 and a focusing electrode 32 to be explained.

In this embodiment, when the insulating layer disposed between the cathode and the gate electrodes 6 and 10 is referred to as the first insulating layer 34, a second insulating layer 30 is formed on the gate electrodes 10 and the first insulating layer 34, and a focusing electrode 32 is formed on the second insulating layer 30. The focusing electrode 32 receives a minus (−) voltage of several tens to several thousand volts, and focuses the electrons passed therethrough.

Opening portions 301 and 321 are formed at the second insulating layer 30 and the focusing electrode 32 to make the passage of electron beams. For instance, an opening portion is formed at the respective sub-pixels defined on the first substrate 2, or opening portions are formed to be in one to one correspondence with the electron emission regions 12. The former case is illustrated in FIG. 7. In this case, the focusing electrode 32 collectively focuses the electrons emitted from the respective sub-pixels.

The second insulating layer 30 is formed with the thick film as with the first insulating layer 34 such that it has a thickness of 3 μm or more, particularly of 3-30 μm. As with the cathode and the gate electrodes 6 and 10, the focusing electrode 32 is formed with the thin film such that it has a thickness of 2,000-3,000 Å. The focusing electrode 32 is formed with a metallic material, such as chromium (Cr), silver (Ag), aluminum (Al), and molybdenum (Mo).

The second insulating layer 30 has a thickness larger than the first insulating layer 34 such that the focusing electrode 32 is placed at the plane higher than the electron emission regions 12. The focusing electrode 32 may be formed on the entire surface of the first substrate 2, or patterned with a plurality of separate portions, the illustration of which is omitted.

The first and the second insulating layers 34 and 30 with the thick film are formed such that the gate and the focusing electrodes 10 and 32 are placed at the plane sufficiently higher than the electron emission region 12, thereby enhancing the uniformity in electron emission and the focusing efficiency. Since it is possible to form the thin-filmed gate and focusing electrodes 10 and 32 with a precise pattern, they are formed on the first and the second insulating layers 34 and 30 with excellent shape precision.

A method of manufacturing the electron emission device according to the third embodiment of the present invention will be now explained with reference to FIGS. 9A to 9C.

Figure 9A:
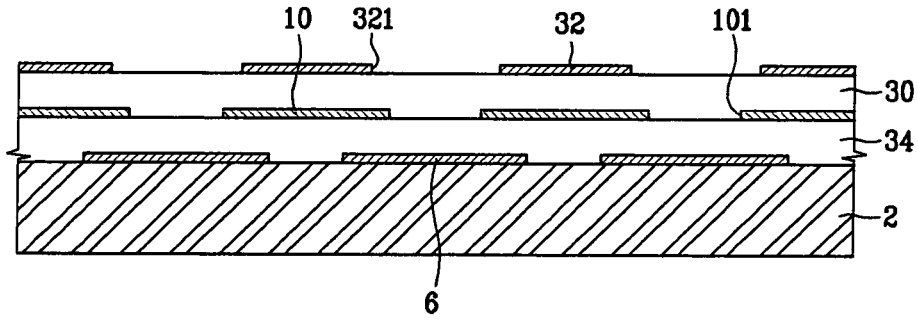
FIGS. 9A, 9B and 9C sequentially illustrate the steps of manufacturing the electron emission device according to the third embodiment of the present invention.

As shown in FIG. 9A, cathode electrodes 6, a first insulating layer 34 and gate electrodes 10 are sequentially formed on the first substrate 2. The gate electrodes 10 are patterned through photolithography and etching, and have opening portions 101 at the crossed regions thereof with the cathode electrodes 6. The gate electrodes 10 are stripe-patterned substantially perpendicular to the cathode electrodes 6.

The first insulating layer 34 is formed by thick filming, such as screen-printing, laminating or doctor blade, such that it has a thickness of 3 μm or more. The gate electrodes 10 are formed by thin filming, such as vacuum deposition or sputtering, such that it has a thickness of several thousands angstroms, particularly of 2,000-3,000 Å.

A second insulating layer 30 is formed on the gate electrodes 10 and the first insulating layer 34. The second insulating layer 30 is also formed by thick filming such that it has a thickness of 3 μm or more, preferably larger than the first insulating layer 34. Thereafter, a focusing electrode 32 is formed on the second insulating layer 30 by thin filming such that it has a thickness of several thousands angstroms. The focusing electrode 32 is patterned through photolithography and etching to thereby form opening portions 321.

Figure 9B:
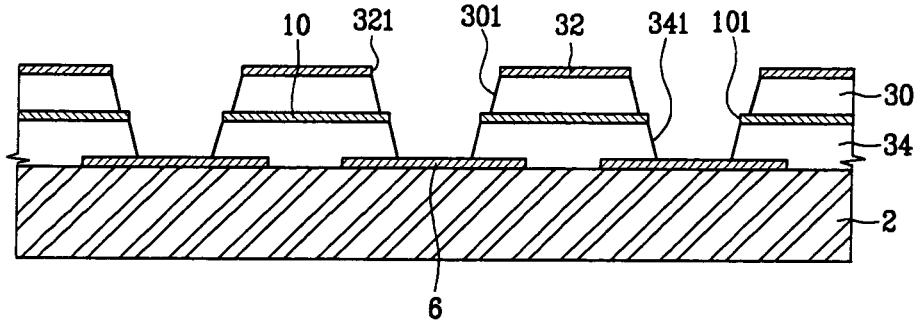

Thereafter, as shown in FIG. 9B, the second insulating layer 30 exposed through the opening portions 321 of the focusing electrode 32, and the underlying first insulating layer 34 are sequentially etched using the focusing electrode 32 as an etching mask. Consequently, opening portions 301 and 341 are formed at the second and the first insulating layers 30 and 34 while partially exposing the surface of the cathode electrodes 6.

Figure 9C:
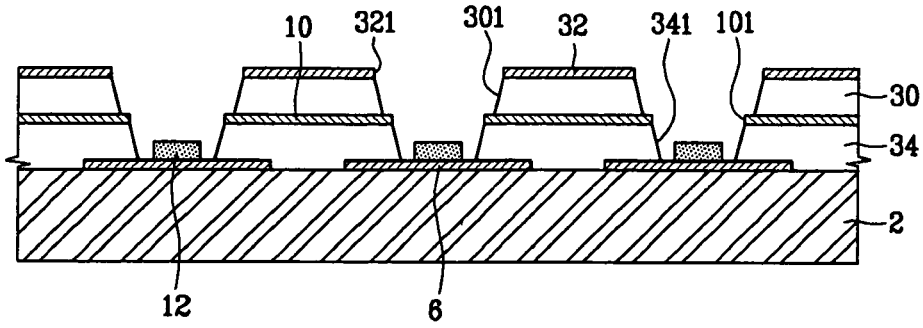

As shown in FIG. 9C, electron emission regions 12 are formed on the cathode electrodes 6 within the opening portions 341 of the first insulating layer 34. The formation of the electron emission regions 12 is made in the same way as with that related to the first embodiment.

Figure 10:
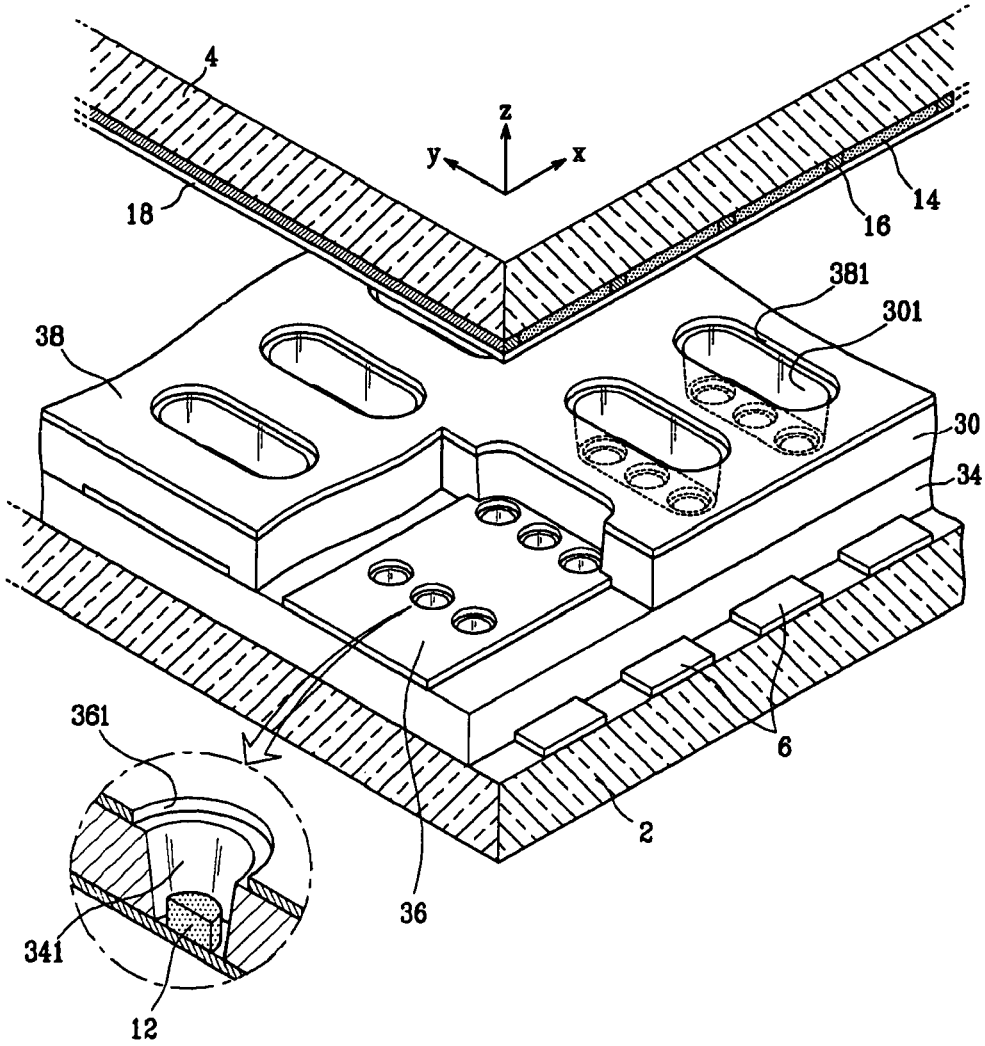
FIG. 10 is a partial exploded perspective view of an electron emission device according to a fourth embodiment of the present invention.
Figure 11:
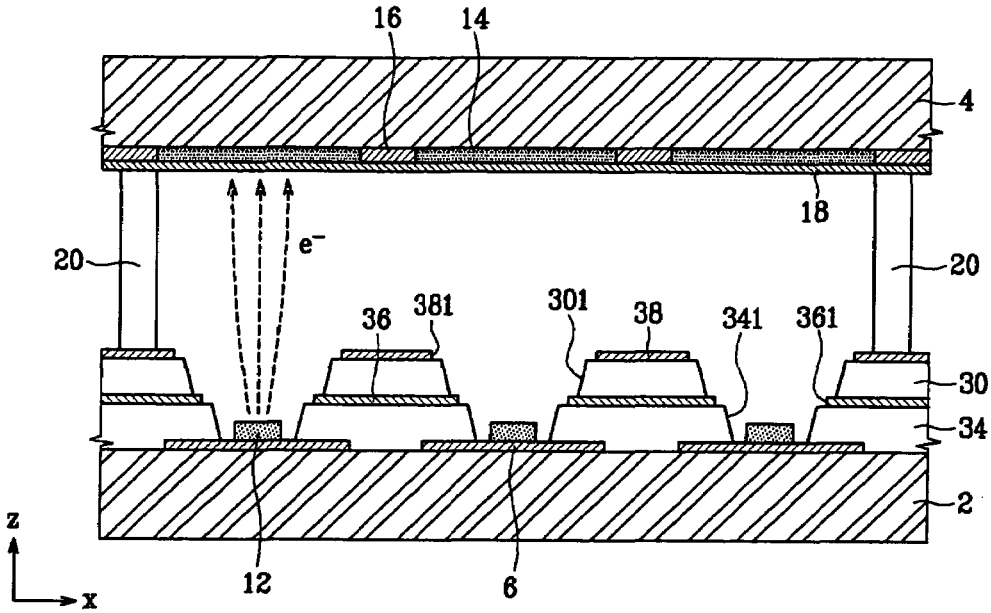
FIG. 11 is a partial sectional view of the electron emission device according to the fourth embodiment of the present invention.

As shown in FIGS. 10 and 11, an electron emission device according to a fourth embodiment of the present invention has the basic structural components of the electron emission device related to the third embodiment as well as gate and focusing electrodes 36 and 38 to be explained below.

In this embodiment, the gate electrodes 36 have opening portions 361 with a width larger than the opening portions 341 of the first insulating layer 34. The opening portions 361 of the gate electrodes 36 partially expose the surface of the first insulating layer 34 with excellent shape precision such that they are spaced apart from the electron emission regions 12 uniformly at a predetermined distance. The focusing electrode 38 has opening portions 381 with a width larger than the opening portions 301 of the second insulating layer 30. The opening portions 381 of the focusing electrode 38 partially expose the surface of the second insulating layer 30 with excellent shape precision. The focusing electrode 38 is spaced apart from the bundle of electron beams uniformly at a predetermined distance.

A method of manufacturing the electron emission device according to the fourth embodiment of the present invention will be now explained with reference to FIGS. 12A to 12F.

Figure 12A:
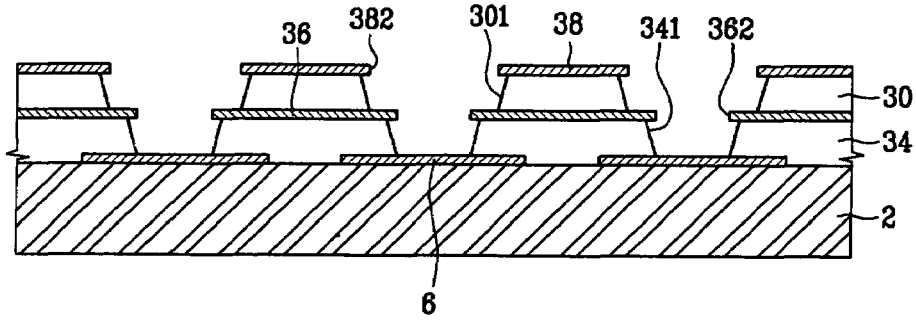
FIGS. 12A, 12B, 12C, 12D, 12E and 12F sequentially illustrate the steps of manufacturing the electron emission device according to the fourth embodiment of the present invention.

As shown in FIG. 12A, cathode electrodes 6, a first insulating layer 34 and gate electrodes 36 are sequentially formed on the first substrate 2. The gate electrodes 36 are patterned through photolithography and etching such that opening portions 362 are formed at the crossed regions thereof with the cathode electrodes 6. The gate electrodes 36 are stripe-patterned substantially perpendicular to the cathode electrodes 6. A second insulating layer 30 and a focusing electrode 38 are formed on the gate electrodes 36 and the first insulating layer 34, and the focusing electrode 38 is patterned to thereby form opening portions 382.

The first and the second insulating layers 34 and 30 are formed by thick filming, such as screen-printing, laminating or doctor blade, such that it has a thickness of 3 μm or more. The gate electrodes 36 and the focusing electrode 38 are formed by thin filming, such as vacuum deposition or sputtering, such that it has a thickness of several thousands angstrom, particularly of 2,000-3,000 Å.

Thereafter, the second insulating layer 30 exposed through the opening portions 382 of the focusing electrode 38, and the underlying first insulating layer 34 are sequentially wet-etched using the focusing electrode 38 as an etching mask. Consequently, opening portions 301 and 341 are formed at the second and the first insulating layers 30 and 34 while partially exposing the surface of the cathode electrodes 6.

The opening portions 382 of the focusing electrode 38 have a width larger than the opening portions 362 of the gate electrodes 36 such that after the etching of the first and the second insulating layers 30 and 34, the opening portions 301 of the second insulating layer 30 have a width larger than the opening portions 362 of the gate electrodes 36.

The first and the second insulating layers 30 and 34 are formed by thick filming such that the opening portions 301 and 341 have a rough wall surface. Furthermore, under-cuts are made due to the wet etching such that the gate electrodes 36 are partially suspended over the opening portions 341 of the first insulating layer 34, and the focusing electrode 38 is partially suspended over the opening portions 301 of the second insulating layer 30.

Figure 12B:
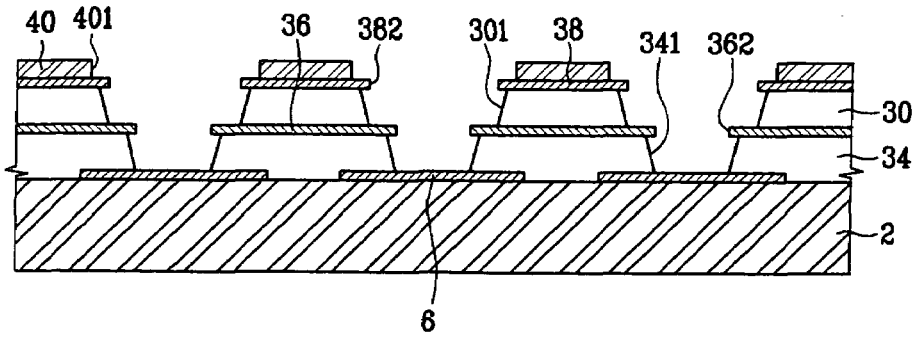
Figure 12C:
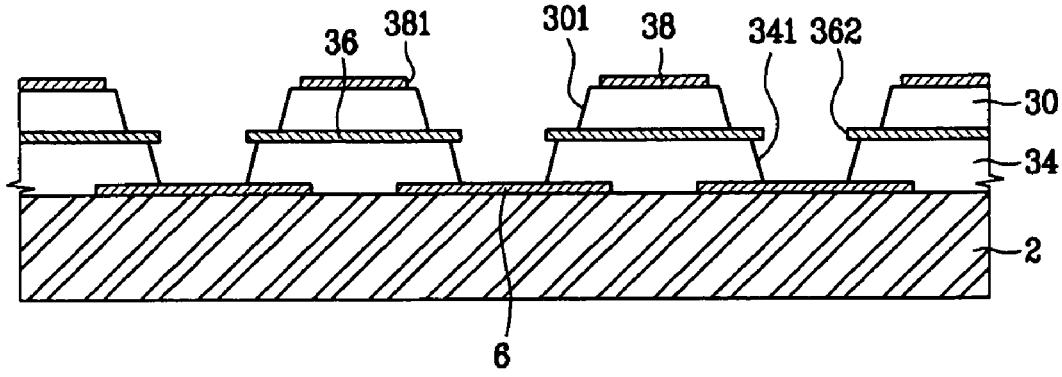

As shown in FIG. 12B, a first mask layer 40 is formed on the focusing electrode 38, and patterned such that opening portions 401 are formed at the first mask layer 40 over the opening portions 382 of the focusing electrode 38 with a width larger than the opening portions 301 of the second insulating layer 30. The portions of the focusing electrode 38 exposed through the opening portions 401 of the first mask layer 40 are etched, and the first mask layer 40 is removed to thereby form opening portions 381 at the focusing electrode 38 with a width larger than the opening portions 301 of the second insulating layer 30, as shown in FIG. 12C.

Figure 12D:
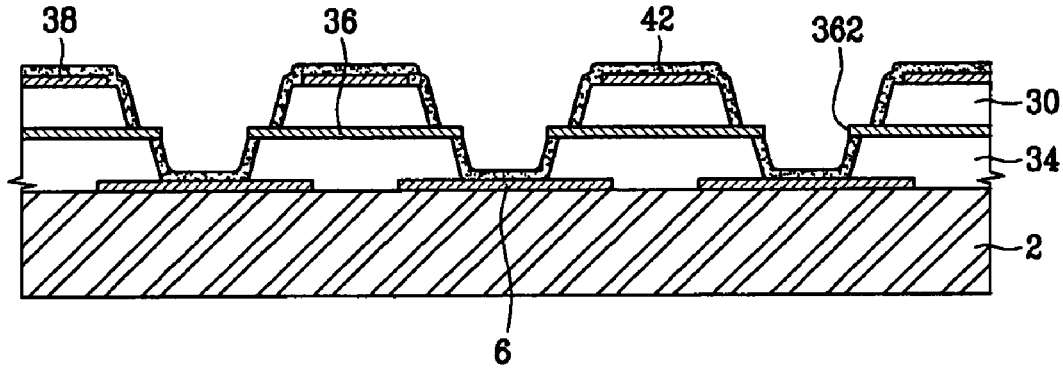
Figure 12E:
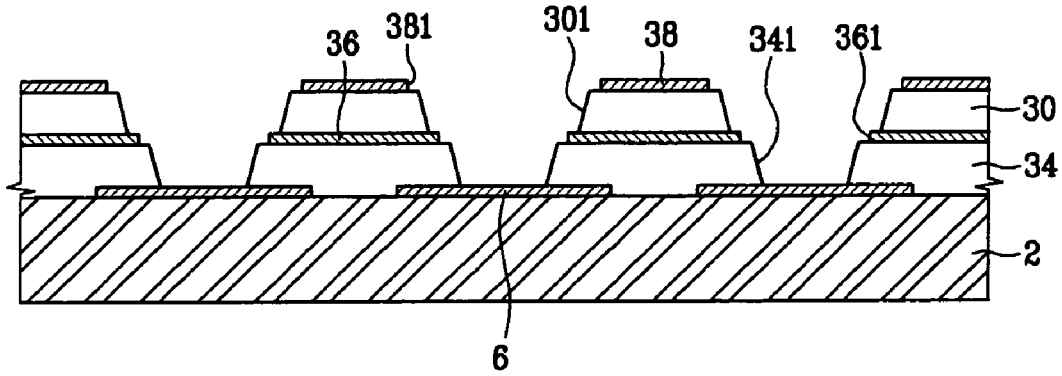

As shown in FIG. 12D, a second mask layer 42 is formed on the entire surface of the structure of the first substrate 2, and patterned to thereby expose the gate electrodes 36 around the opening portions 362 with a predetermined width. The portions of the gate electrodes 36 exposed through the second mask layer 42 are etched, and the second mask layer 42 is removed. Consequently, as shown in FIG. 12E, opening portions 361 are formed at the gate electrodes 36 with a width larger than the opening portions 341 of the first insulating layer 34.

Figure 12F:
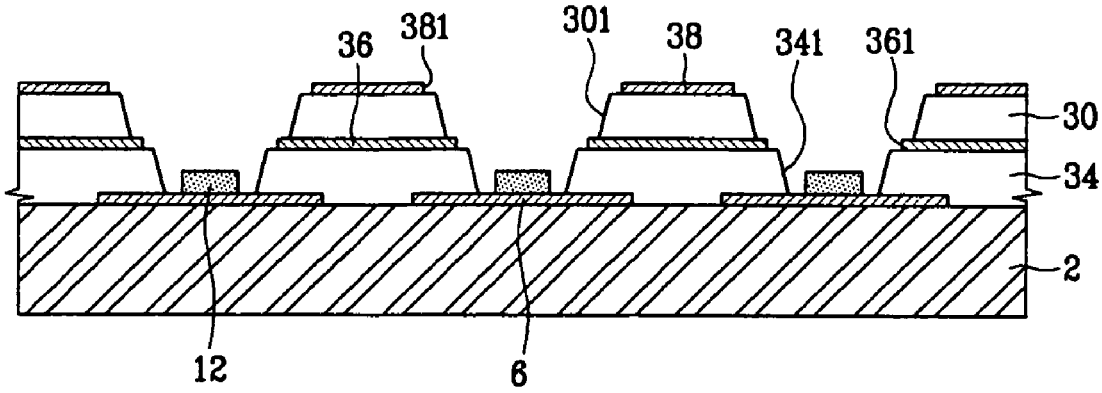

As shown in FIG. 12F, electron emission regions 12 are formed on the cathode electrodes 6 within the opening portions 341 of the first insulating layer 34. The formation of the electron emission regions 12 is made in the same way as with that related to the first embodiment.

With the above-described method, opening portions 341 and 301 are formed at the first and the second insulating layers 34 and 30, and the focusing and the gate electrodes 38 and 36 are etched once more using the first and the second mask layers 40 and 42, thereby forming opening portions 381 and 361 with excellent shape precision irrespective of the shape of the opening portions 341 and 301 of the insulating layers 34 and 30. Accordingly, the gate electrodes 36 are spaced apart from the electron emission regions 12 uniformly at a predetermined distance, and the focusing electrode 38 is spaced apart from the bundle of electron beams uniformly at a predetermined distance. As a result, the uniformity in electron emission becomes enhanced, and the electron beam focusing efficiency becomes heightened.

Figure 13:
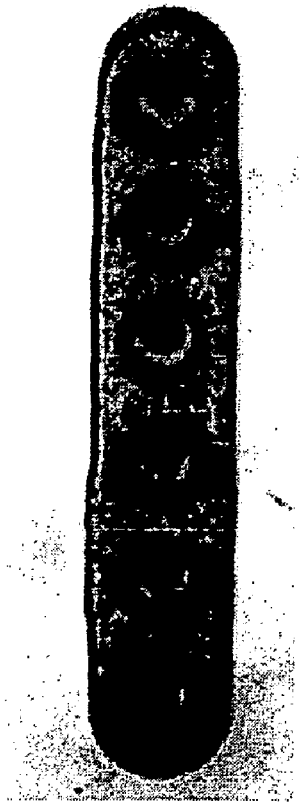
FIG. 13 is an amplified photograph of the structure on a first substrate for the electron emission device according to the fourth embodiment of the present invention.
Figure 14:
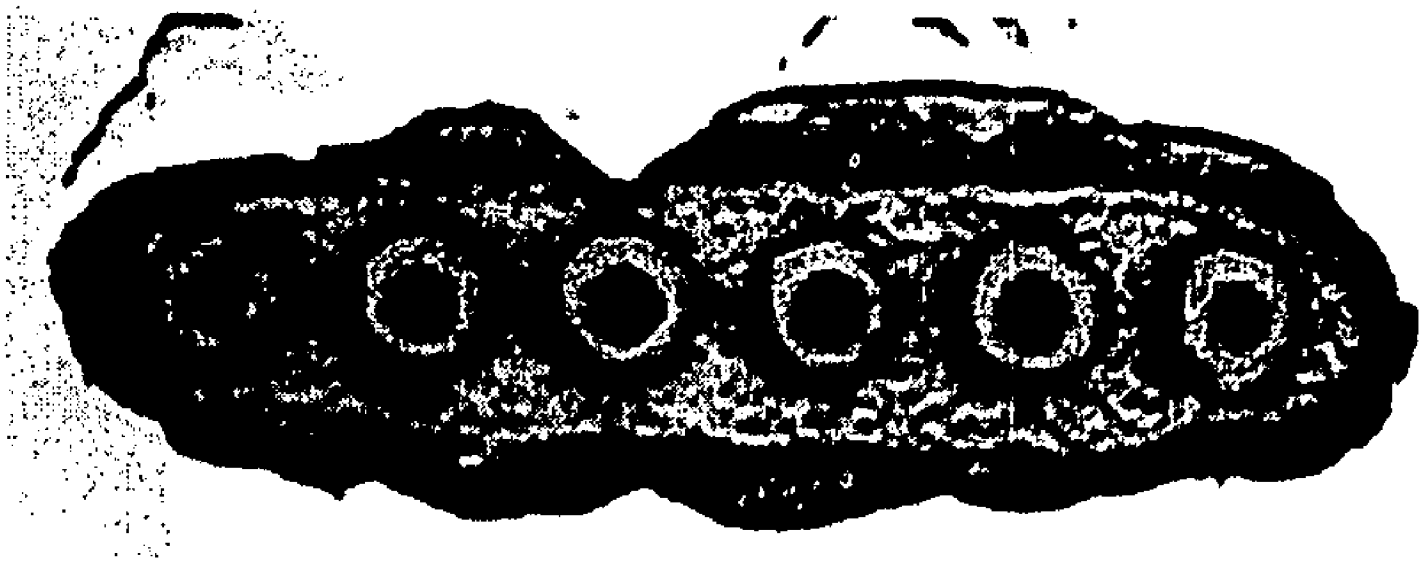
FIG. 14 (Prior Art)
FIG. 14 is an amplified photograph of the structure on a first substrate for an electron emission device according to a prior art.

FIGS. 13 and 14 are amplified photographs of the structure on the first substrate for the electron emission device according to the fourth embodiment of the present invention and the structure on a first substrate for an electron emission device according to a prior art, respectively.

As shown in FIG. 13, with the electron emission device according to the embodiment of the present invention, opening portions with excellent shape precision are formed at the gate and the focusing electrodes. By contrast, as shown in FIG. 14, with the electron emission device according to the prior art, opening portions with poor patterning precision are formed at the gate and the focusing electrodes, and particularly, the opening portions of the focusing electrode have a rough plane shape.

As described above, with the inventive electron emission device, the shape stability and the patterning precision of the insulating layers and the electrodes can be enhanced, thereby making it possible to fabricate a high resolution and high image quality device. Furthermore, opening portions with excellent shape precision are formed at the gate and the focusing electrodes, thereby stabilizing the electron emission characteristic and enhancing the beam focusing efficiency.

Although it is explained above that the inventive structure is applied to the FEA-typed electron emission device, the structure is not limited thereto. The structure may be easily applied to other-typed electron emission devices.

Although exemplary embodiments of the present invention have been described, it should be clearly understood that many variations and/or modifications of the basic inventive concept herein taught which may appear to those skilled in the art will still fall within the spirit and scope of the present invention, as defined in the appended claims.

What is claimed is:

1. An electron emission device comprising:

first and second substrates facing each other at a distance;

cathode electrodes on the first substrate;

electron emission regions on the cathode electrodes;

a first insulating layer on the cathode electrodes with first insulating layer opening portions exposing the electron emission regions;

gate electrodes on the first insulating layer with gate electrode opening portions corresponding to the first insulating layer opening portions; and a second insulating layer on the gate electrodes with second insulating layer opening portions each exposing a plurality of the first insulating layer opening portions, wherein the cathode electrodes and the gate electrodes each comprise a thin film deposition, and the insulating layer comprises a thick film layer;

wherein the cathode electrodes and the gate electrodes respectively have a thickness ranging from 2,000 Å to 3,000 Å;

wherein the gate electrode opening portions have a width larger than the insulating layer opening portions; and wherein a top surface of the second insulating layer adjacent to the second insulating layer opening portions is substantially flat.

2. The electron emission device of claim 1, wherein the first insulating layer has a thickness of 3 μm or more.

3. The electron emission device of claim 1, wherein the gate electrodes are spaced apart from the electron emission regions uniformly.

4. The electron emission device of claim 1, wherein the electron emission regions comprise a material selected from the group consisting of carbon nanotube, graphite, graphite nanofiber, diamond, diamond-like carbon, C60, and silicon nanowire.

5. The electron emission device of claim 1, further comprising a focusing electrode on the second insulating layer, the focusing electrode having focusing electrode opening portions corresponding to the second insulating layer opening portions.

6. The electron emission device of claim 5, wherein portions of the focusing electrode adjacent to the focusing electrode opening portions are substantially flat.

* * * * *